US006025682A

United States Patent [19]

Bruntz et al.

[11] Patent Number: 6,025,682

[45] Date of Patent: Feb. 15, 2000

[54] INFINITELY VARIABLE WASH ACTION

[75] Inventors: Jordan S. Bruntz, Baxter; David I. Ellingson, Newton, both of Iowa

[73] Assignee: Maytag Corporation, Newton, Iowa

[21] Appl. No.: 09/124,606

[22] Filed: Jul. 29, 1998

[51] Int. Cl.[7] ..... H02P 5/46

[52] U.S. Cl. ..... 318/66; 318/254; 318/138; 318/439; 318/779; 318/778; 318/811

[58] Field of Search ..... 318/254, 138, 318/439, 779, 778, 811, 66

[56] References Cited

U.S. PATENT DOCUMENTS 3,474,646 10/1969 Sims et al. .
3,589,148 6/1971 Wasemann .
4,215,303 7/1980 Brimer ..... 318/752
4,513,230 4/1985 Erdman ..... 318/254
4,835,991 6/1989 Knoop et al. ..... 318/254
4,950,969 8/1990 Getz .
4,972,134 11/1990 Getz et al. .
5,074,003 12/1991 Manson et al. ..... 318/138
5,271,116 12/1993 Williams .
5,333,474 8/1994 Imai et al. .
5,515,565 5/1996 Maddix et al. ..... 318/254

*Primary Examiner*—Karen Masih
*Attorney, Agent, or Firm*—Zarley, McKee, Thomte, Voorhees & Sease

[57] ABSTRACT

A wash action control system is used to control the agitation speed of a washing machine. The invention includes a wash speed selection switch which controls the agitation speed of the agitator. The wash speed selection switch has an infinite number of possible wash speed settings and includes various secondary switches for affecting various aspects of the wash speed control.

17 Claims, 3 Drawing Sheets

WATER TEMP SWITCH
49
H-C
W-C
C-C
W-W
44
HOT
COLD
WATER VALVE
TIMING CIRCUIT
46
R1
R2
D1
R4
R5
R3
DIAC1
DIAC2
SCR1
SCR2
SCR3
SCR4
C1
C2
C3
Z1
16
R7
38
42
34
36
40
32
FAST
ASSURED FAST
SLOW
WATER LEVEL SWITCH
FULL
EMPTY
48
DRIVE MOTOR
CENT SW
START
OVERLOAD PROTECTOR
REG
SLOW
54
60
58
TIMER MOTOR
56
50
52
LID SWITCH
L1
N
T
B

INFINITELY VARIABLE WASH ACTION

BACKGROUND OF THE INVENTION

1. Field of the Invention

The present invention relates to washing machines. More particularly, though not exclusively, the present invention relates to a method and apparatus for controlling the wash action in a washing machine.

2. Problems in the Art

In addition to controlling things such as water level and water temperature, controlling the wash action in a washing machine has been used to wash clothing in an effective and efficient manner and to accommodate a wide variety of fabrics. For example, in some circumstances, a slow agitation speed is desired. In other circumstances, a fast agitation speed is desired. A typical prior art washing machine may include a wash cycle selection switch on a control panel. However, a user is typically limited to a certain number of predetermined wash cycle settings, each having predetermined wash speeds.

3. Features of the Invention

A general feature of the present invention is the provision of a method and apparatus for providing a wash action control system for a washing machine which overcomes problems found in the prior art.

A general feature of the present invention is the provision of a method and apparatus for providing a wash action control system for a washing machine which provides a user with an infinite number of wash action settings from which to choose.

Further features, objects and advantages of the present invention include:

A method and apparatus for providing a wash action control system for a washing machine which allows a user to choose from an infinite number of agitation speed variations between a fast and a soak setting.

A method and apparatus for providing a wash action control system for a washing machine which utilizes a slide potentiometer and a timing circuit to create an infinite wash action control system.

These as well as other features, objects and advantages will become apparent from the following specification and claims.

SUMMARY OF THE INVENTION

The wash action control system of the present invention is used to control the agitation speed and thus the wash action of a washing machine. The invention is comprised of a user adjustable wash speed selection switch operatively coupled to the motor for controlling the speed of agitation. The wash speed selection switch has a substantially infinite number of possible wash speed settings. The switch may also include various secondary switches for affecting various aspects of the wash speed control.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalencies which may be included within the spirit and scope of the invention.

Figure 1:
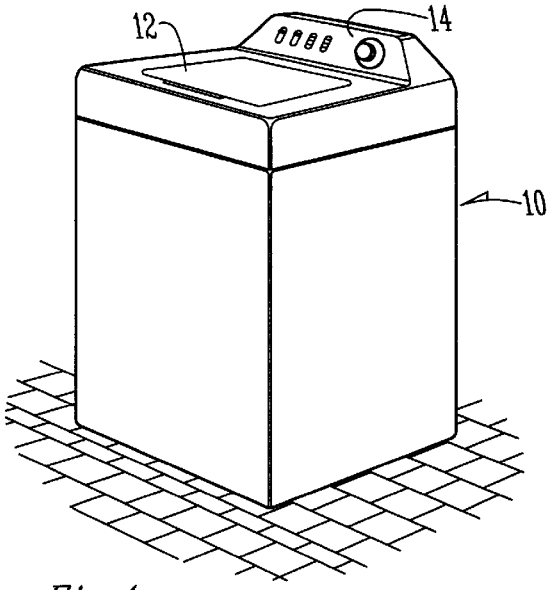
FIG. 1 is a perspective view showing a washing machine of the present invention.

FIG. 1 is a perspective view of a washing machine 10 of the present invention. As shown, the washing machine 10 includes a door 12 which provides access to the interior of the washing machine 10. Disposed within the washing machine 10 is a conventional wash tub and agitator (not shown). The washing machine 10 also includes a control panel 14 which allows a user to control the various functions of the washing machine 10.

Figure 2:
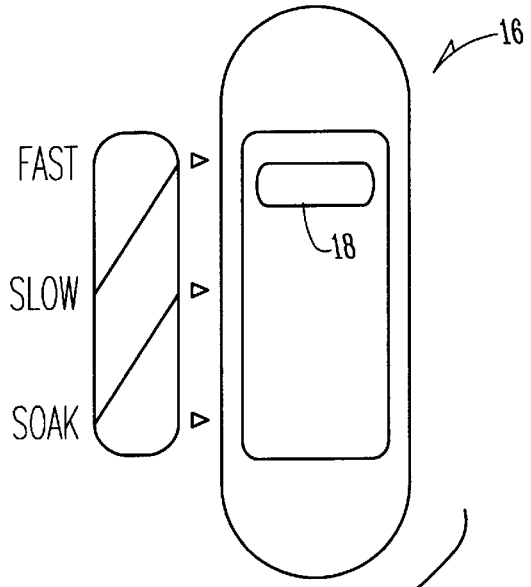
FIG. 2 is a view of the wash speed selector of the present invention.

FIG. 2 is an enlarged view of a wash speed selector 16 which is a part of the control panel 14 shown in FIG. 1. The wash speed selector 16 includes a slider switch 18 which is described in more detail below. To the left of the slider switch 18 is indicia providing the user with a guide of the wash speed selected. As shown, as the slider switch 18 is moved up and down, a wash speed can be selected between SOAK, SLOW, and FAST. The operation of the slider switch 18 in conjunction with the indicia shown in FIG. 2 is described in detail below.

Figure 3:
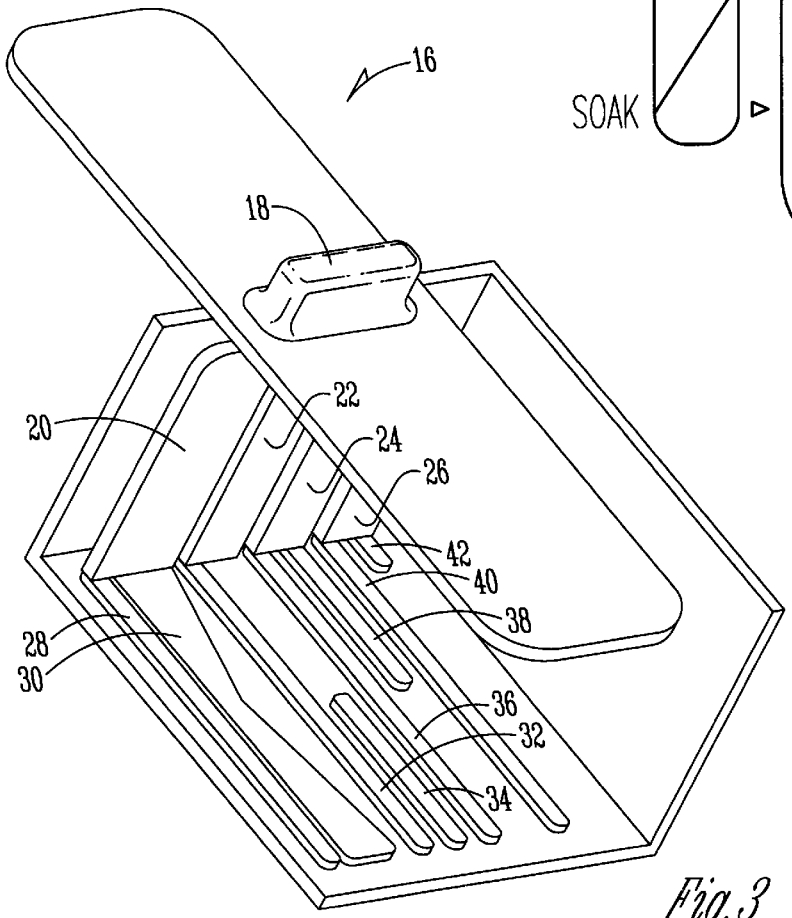
FIG. 3 is a perspective view of the wash speed selector of the present invention.

FIG. 3 is a perspective view of the wash speed control selector 16 shown in FIG. 2. As shown, the slider switch 18 is coupled to four wipers 20, 22, 24, and 26. When the slider switch 18 is moved up or down, the wipers 20, 22, 24, and 26 move with the slider switch 18. FIG. 3 also shows eight conductive strips 28, 30, 32, 34, 36, 38, 40, and 42 which are described below.

Figure 4:
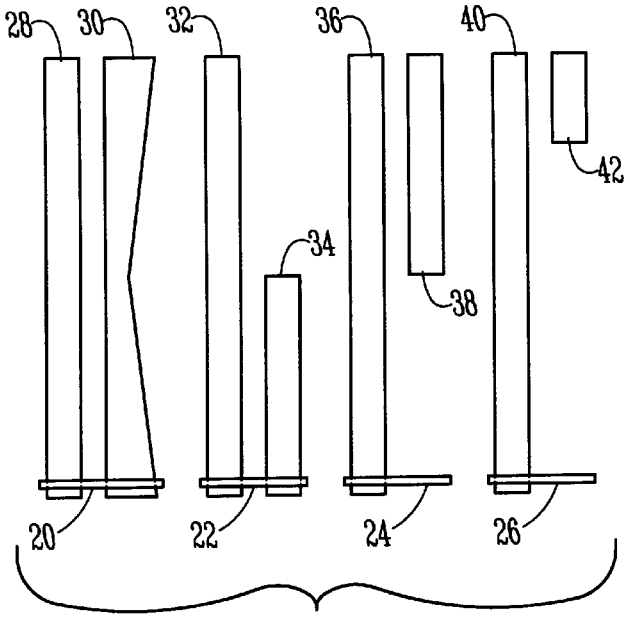
FIG. 4 is a view illustrating the variable resistor and discrete switches of the wash speed selector shown in FIG. 3.

FIG. 4 is a view of the wipers 20, 22, 24, and 26 in conjunction with the conductive strips 28, 30, 32, 34, 36, 38, 40, and 42 illustrating the relationship between the wipers and the conductive strips. The wipers 20, 22, 24, and 26 are each electrically conductive and provide a short between the conductive strips which they contact.

Figure 5:
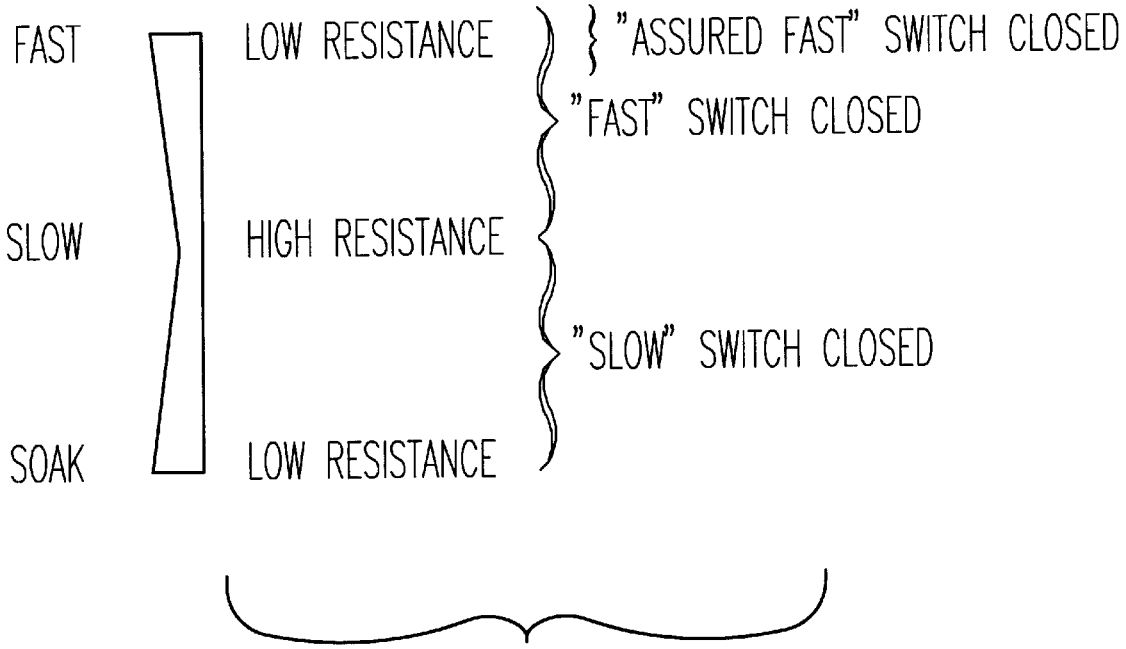
FIG. 5 is a diagram illustrating the washing machine functions with respect to the wash speed selector position.

FIG. 5 is a diagram illustrating the washing machine functions with respect to the position of the wash speed selector 16. FIGS. 4 and 5 show the relationship between the functions of the washing machine 10 with respect to the switches formed by the combinations of sliders and conductive strips.

The first wiper 20 makes electrical contact with first and second conductive strips 28 and 30. The second conductive strip 30 is a resistive strip having a varying width, and therefore a varying resistance, depending on the position of the wiper 20. In accordance with FIG. 5, the resistance of the combination of conductive strips 28 and 30 is low when the wiper 20 is at an extreme position, and is highest when the wiper 20 is centered. In the preferred embodiment, the resistance of conductive strip 30 varies between 100Ω and 30 KΩ. The second wiper 22 makes electrical contact with the conductive strips 32 and 34. The wiper 22 shorts conductive strips 32 and 34 together when the wiper 22 is below the center position. The third wiper 24 makes electrical contact with the conductive strips 36 and 38. The wiper 24 shorts conductive strips 36 and 38 together when the wiper 24 is above the center position. The fourth wiper 26 makes electrical contact with the conductive strips 40 and 42. The wiper 26 shorts conductive strips 40 and 42 together when the wiper 26 is at the uppermost position.

In an alternate embodiment, detents can be provided in the slider switch 18 to accurately locate certain positions, such as the center position. In addition, the slider switch 18 can be comprised of a rotary switch.

Figure 6:
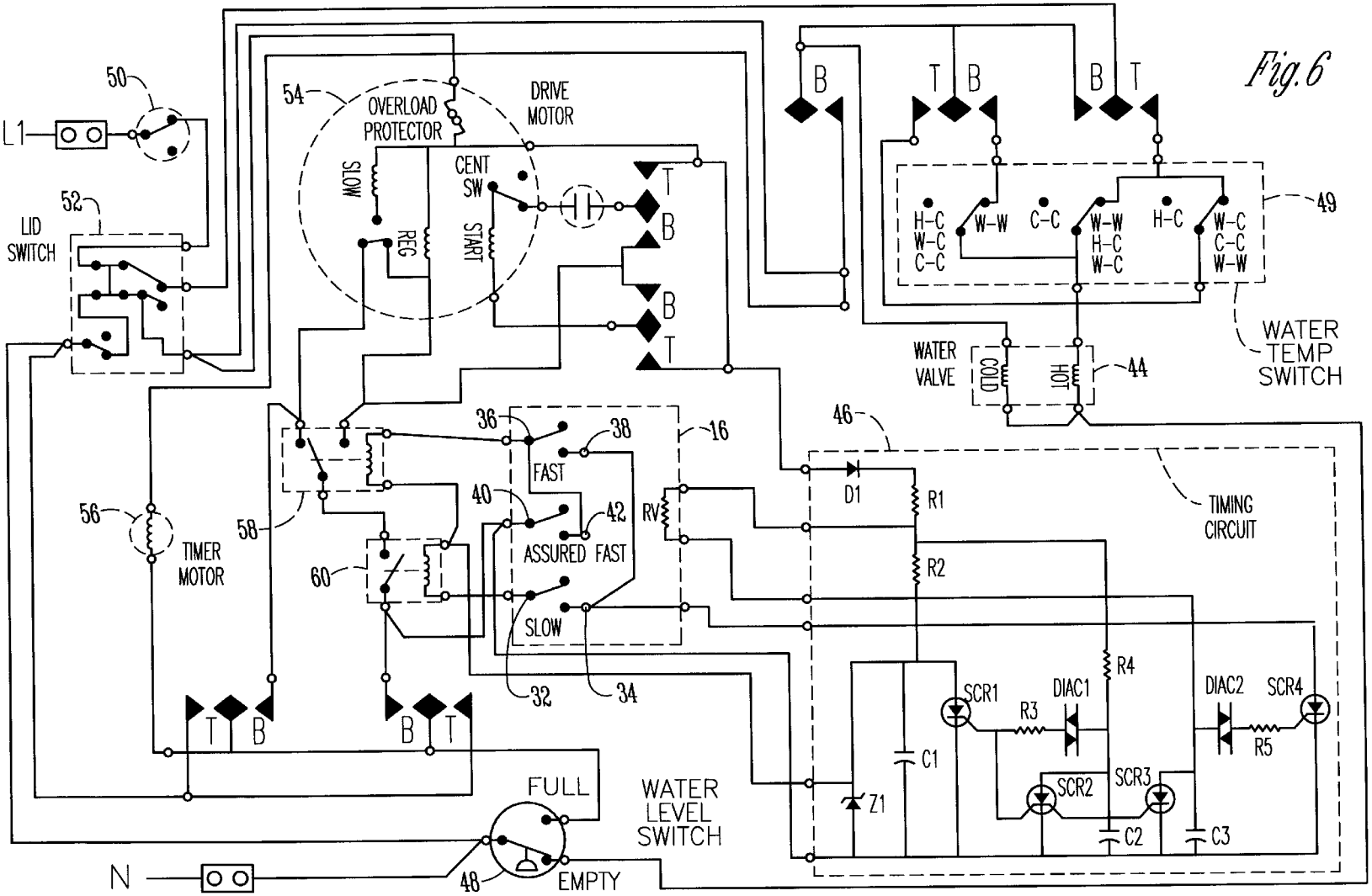
FIG. 6 is an electrical schematic diagram of the control system of the present invention.

FIG. 6 is an electrical schematic diagram of the control system of the present invention. FIG. 6 illustrates how the slider switch 18 is used to control the speed of the drive motor 54 and the wash action of washing machine 10. The main components of the washing machine 10 shown in FIG. 6 include a water valve 44, a timing circuit 46, a water level switch 48, various timer cams, a water temperature switch 49, a timer line switch 50, a lid switch 52, a drive motor 54, a timer motor 56, and relays 58 and 60. The diagram of FIG. 6 also illustrates how the various conductive strips of the wash speed selector 16 are incorporated into the control system.

The timing circuit 46 (described in detail below) makes a connection to a variable resistor $R_v$. The variable resistor $R_v$ is comprised of the combination of the conductive strips 28 and 30 shown in FIG. 4. As mentioned above, the resistance of the variable resistor $R_v$ is varied depending on the position of the wiper 20 relative to the conductive strips 28 and 30. The resistance of the variable resistor $R_v$ effects the duty cycle of the timing circuit 46.

When the slider switch 18 is between the center position and its lowermost position, the variable resistor $R_v$ will have a value between its maximum and minimum resistance, depending on the position of the slider 20. As shown in FIG. 4, the conductive strips 32 and 34 are shorted together which allows the relay 60 to be energized as further discussed in conjunction with the description of the timing circuit 46. The conductive strips 36 and 38, and the conductive strips 40 and 42 are open, preventing relay 58 from energizing. The result of this setting is a slow/off setting, with the drive motor 54 repeatedly switching from low to off (as a result of the timer circuit 46 described below). The closer the slider switch 18 is to SOAK, the longer the drive motor 54 is off.

When the slider switch 18 is in the center position, the variable resistor $R_v$ will have its maximum resistance. The conductive strips 32 and 34 are now open, which prevents the relay 60 from energizing. The conductive strips 40 and 42 and conductive strips 36 and 38 are now open which prevents the relay 58 from energizing. The result of this setting is a continuous slow speed of the drive motor 54 and a continuous slow speed agitation.

When the slider switch 18 is between the center position and just below its uppermost position, the conductive strips 32 and 34, and the conductive strips 40 and 42 remain open which prevents relay 60 from energizing. The conductive strips 36 and 38 remain shorted which allows the relay 58 to energize (as a result of the timer circuit 46 described below). The result of this setting is a fast/slow setting, with the drive motor 54 repeatedly switching from high to low speeds. The frequency of this switching is dependent on the resistance of variable resistor $R_v$, and therefore, the position of the slider 20. The closer the slider switch 18 is to FAST, the longer the drive motor 54 stays on at the high speed.

When the slider switch 18 is at its uppermost position, the variable resistor $R_v$ will have its minimum value. The conductive strips 32 and 34 remain open which prevents relay 60 from energizing. The conductive strips 36 and 38 remain shorted which allows the relay 58 to energize. Conductive strips 40 and 42 are now shorted which ensures that relay 58 is energized. The result of this setting is continuous high speed operation of the drive motor 54 and a resulting continuous high speed agitation.

It can be seen that the wash or agitation speed of the washing machine 10 can be infinitely varied between a slow and a fast speed. Because of the infinite number of possible positions of the wipers 20, 22, 24 and 26, an infinite number of wash or agitation speed settings can be achieved.

The timing circuit 46 of the present invention operates in the following manner. In the timing circuit 46, a DC power supply is provided by a diode D1, resistor R1, resistor R2, capacitor C1, and Zener diode Z1. When power is applied to the timing circuit 46, the capacitor C3 begins charging through the variable resistor $R_v$. When the voltage across the capacitor C3 reaches 35 volts, the diac DIAC2 conducts and gates the silicon controlled rectifier SCR4 through resistor R5. When this happens, the relay 60 is activated, but only if the conductive strips 32 and 34 are shorted by the wiper 22 (a setting between SOAK and SLOW). If the conductive strips 36 and 38 are shorted (a setting between SLOW and FAST), the relay 58 will be energized. While capacitor C3 is charging, capacitor C2 also charges through resistor R4. When the voltage across capacitor C2 reaches 35 volts, the diac DIAC1 conducts and gates the silicon controlled rectifiers SCR1, SCR2, and SCR3. This discharges the capacitors C2 and C3 and the timing sequence described above begins again. At this time, the coil of relay 58 or 60 is shorted, and the current through the relay coil is not sufficient to hold silicon controlled rectifier SCR4 on.

Note that as the variable charge rate of $R_v$C3 approaches the fixed rate of R4C2, the time of the relay approaches 0 seconds. The frequency of the timing circuit 46 is fixed by R4C2, and the pulse width is set by $R_v$C3. The timing circuit 46 is therefore a pulse width modulator.

The wash or agitation speed control system of the present invention operates in the following manner. If a user selects a wash speed between SOAK and SLOW (the lower half of the wash speed selector 16), the conductive strips 32 and 34 are shorted together, which allows the relay 60 to be energized by the timing circuit 46. The timing circuit 46 will cause the relay 60 to switch on and off at a frequency dependent upon the value of the variable resistor $R_v$. The closer the slider 18 is to SLOW, the longer the relay 60 will be turned off.

If a user selects SLOW (the center position of the wash speed selector 16), the conductive strips 32 and 34 are open, and the conductive strips 36 and 38 are shorted together, which allows the relay 58 to be energized. The closer the slider 18 is to SLOW, the longer the relay 58 will be turned off. The result is a constant slow speed of drive motor 54 and a constant slow agitation speed.

If a user selects a wash speed between SLOW and FAST (the upper half of the wash speed selector 16), the conductive strips 36 and 38 are shorted together, which allows the relay 58 to be energized by the timing circuit 46. The timing circuit 46 will cause the relay 58 to switch on and off at a frequency dependent upon the value of the variable resistor $R_v$. The result is that the drive motor 54 repeatedly switches from high to low speeds. The closer the slider 18 is to FAST, the longer the drive motor 54 will remain on the high speed providing a high speed agitation.

If a user selects FAST (the uppermost position of the wash speed selector 16), the conductive strips 40 and 42 are shorted together, which assures a continuous high speed operation of the drive motor 54 and high speed agitation.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A wash action control system for a washing machine having a wash tub, an agitator disposed within the wash tub, and a motor for moving said agitator comprising:

an electrical control circuit connected to said motor for causing said motor to move said agitator at varying rates of speed;

a user adjustable wash speed selection switch within said electrical control circuit;

said selection switch including a movable member, a variable resistance element, and a plurality of switch members;

said movable member being continuously movable from a soak position wherein said control circuit causes said motor to alternate between moving the agitator slowly and not moving the agitator at all, to a slow position wherein said control circuit causes the motor to move said agitator slowly and continuously, to a fast position wherein said control circuit causes said motor to alternate between moving the agitator slowly and fast, and to an assured fast position wherein said control circuit causes said motor to move the agitator fast continuously.

2. A wash action control system according to claim 1 wherein said movable member includes a wiper member which remains in contact with said variable resistance element throughout movement through said soak, slow, fast, and assured fast positions.

3. A wash action control system according to claim 2 wherein said electrical control circuit further comprises a timer circuit adapted to create a timer signal which controls time periods of actuation and deactuation of said motor, said resistance element and said wiper comprising a variable resistor and being electrically connected to said timer circuit for causing said timer circuit to vary the length of said timer signal in response to the variation in resistance of said variable resistor.

4. A wash action control system according to claim 3 wherein said control circuit includes a first relay connected to at least some of said switch members and said motor for causing said motor to move said agitator at a slow speed.

5. A wash action control system according to claim 4 wherein said control circuit includes a second relay connected to at least some of said switch members and said motor for causing said motor to move said agitator at a fast speed faster than said slow speed.

6. A wash action control system according to claim 5 wherein said movable member contacts a first combination of said plurality of switch members to connect said first relay to said timer circuit when in said soak position and contacts a second combination of said plurality of switch members to connect said timer circuit to said second relay when in said fast and assured fast positions.

7. A wash action control system for a washing machine having a wash tub, an agitator disposed within the wash tub, and a motor for moving said agitator comprising:

a timer circuit capable of creating a timer signal;

a user adjustable selection switch connected to said timer circuit and being continuously movable to an infinite number of positions to cause said timer circuit to vary the length of said timer signal infinitely;

additional control circuitry connected to said motor and responsive to said timer signal for alternating activation and deactivation of said motor, said activation of said motor being only for a length of time corresponding to the length of said signal, whereby movement of said selection switch to said infinite number of positions causes infinite adjustment of the time said motor alternates between moving and not moving said agitator.

8. A wash action control system according to claim 7 wherein said additional control circuitry includes a first relay for causing said motor to move said agitator at a first speed and a second relay for causing said motor to move said agitator at a second speed faster than said first speed.

9. A wash action control system according to claim 8 wherein said selection switch includes switch mechanism connected to said first and second relays, said selection switch being movable from a slow switch position activating said first relay for causing said motor to move said agitator at said first speed to a fast switch position activating said second relay for causing said motor to move said agitator at said second speed.

10. A wash action control system according to claim 9 wherein said selection switch causes said timer circuit to increase the length of said timer signal as said selection switch approaches said second switch position.

11. A method of controlling the movement of an agitator within a washing machine comprising:

connecting a motor to said agitator for moving said agitator;

controlling the speed at which said motor moves said agitator with a control circuit having a control switch movable between soak, slow, fast, and assured fast positions;

moving said control switch to said soak position whereby said control circuit causes alternating activating of said motor for moving said agitator slowly and deactivating of said motor for stopping movement of said agitator;

moving said control switch to said slow position whereby said control circuit causes said motor to move said agitator slowly and continuously;

moving said control switch to said fast position whereby said control circuit causes said motor to move said agitator at alternating slow and fast speeds;

moving said control switch to said assured fast position whereby said control circuit causes said motor to move said agitator continuously at said fast speed.

12. A method according to claim 11 and further comprising delivering a timer signal to said motor for alternate actuation and deactuation of said motor; varying the characteristics of said timer signal in response to movement of said control switch to said soak, slow, fast, and assured fast positions, whereby the length of times of activating and deactivating said motor varies in response to the position of said control switch.

13. A method according to claim 12 wherein said step of varying the characteristics of said timer signal is accomplished by changing the resistance in a variable resistor.

14. A method according to claim 13 wherein said changing of the resistance in said variable resistor is accomplished by movement of said control switch to said soak, slow, fast, and assured fast positions.

15. A method for controlling the wash action of a washing machine having a wash tub, an agitator within said wash tub, and a motor for moving said agitator, said method comprising:

using a timer circuit to create a timer signal having predetermined characteristics;

activating said motor for an activation time period and deactivating said motor for a deactivation time period, the lengths of said activation time period and said deactivation time period being determined by said characteristics of said timer signal;

varying said characteristics of said timer signal to cause variations in the respective lengths of said activation and deactivation time periods;

said varying step being caused by moving a control switch connected to a timer circuit to an infinite number of positions between first and second positions.

16. A method according to claim 15 wherein said varying step further comprises changing the resistance of a variable resistor within said control switch to cause said timer circuit to change the characteristics of said timer signal.

17. A method according to claim 15 and further comprising changing the speed at which said motor moves said agitator in response to movement of said control switch between said first and second positions.

* * * * *